US005263225A

United States Patent [19]

Winters

[11] Patent Number: 5,263,225

[45] Date of Patent: Nov. 23, 1993

[54] WET/DRY VACUUM SYSTEM

[76] Inventor: Richard A. Winters, 2970 Cimarron Trail, #2, Madison, Wis. 53719

[21] Appl. No.: 857,531

[22] Filed: Mar. 25, 1992

[51] Int. Cl.[5] ..... A47L 7/00

[52] U.S. Cl. ..... 15/353; 55/319; 55/466; 55/467

[58] Field of Search ..... 15/321, 353; 55/319, 55/466, 467

[56] References Cited

U.S. PATENT DOCUMENTS

| | | | |
|---|---|---|---|
| 2,461,815 | 2/1949 | Gill | 55/467 X |
| 2,657,416 | 11/1953 | Smith | 15/353 X |
| 2,867,231 | 1/1959 | Gerstmann | 15/353 X |
| 3,180,071 | 4/1965 | Nolte | 15/353 X |
| 3,331,090 | 7/1967 | Reiber et al. . | |
| 3,343,199 | 9/1967 | Nolte | 15/353 X |
| 3,605,786 | 9/1971 | Machin, Jr. . | |
| 3,896,521 | 7/1975 | Parise | 15/353 X |
| 3,971,400 | 7/1976 | Thompson . | |
| 4,083,705 | 4/1978 | Parise et al. | 15/353 X |
| 4,095,398 | 6/1978 | Aumann et al. | 15/353 X |
| 4,171,208 | 10/1979 | Lowder | 15/353 X |
| 4,179,768 | 12/1979 | Sawyer | 15/353 X |
| 4,179,769 | 12/1979 | Lundquist | 15/353 |
| 4,290,348 | 9/1981 | Morgan et al. | 55/319 |
| 4,307,484 | 12/1981 | Williams | 15/353 X |
| 4,332,041 | 6/1982 | Kristoffersen . | |
| 4,378,611 | 4/1983 | Ninehouser | 15/353 |
| 4,476,608 | 10/1984 | Rausmussen | 15/353 |
| 4,608,062 | 8/1986 | Hughes | 15/353 X |
| 4,696,075 | 9/1987 | Grave | 15/353 X |
| 4,826,514 | 5/1989 | Griffis | 15/353 X |
| 4,841,595 | 6/1989 | Wiese | 15/353 X |

FOREIGN PATENT DOCUMENTS

| | | | |
|---|---|---|---|
| 3231679 | 3/1984 | Fed. Rep. of Germany | 15/353 |
| 3410090 | 9/1985 | Fed. Rep. of Germany | 15/353 |
| 2484558 | 12/1981 | France | 15/353 |
| 2219524 | 12/1989 | United Kingdom | 15/353 |

*Primary Examiner*—Stephen F. Gerrity
*Attorney, Agent, or Firm*—Ross & Stevens

[57] ABSTRACT

A wet/dry vacuum system for collecting fluids and particular debris is provided. The system includes a collection tank, a removable cover providing a substantially air-tight connection with the tank, and air inlet and outlet apertures. The cover includes a barrier strip integral with the internal surface of the cover. The barrier strip is designed to control the intake of debris and to prevent the system from clogging. The barrier strip is provided with air passage connections to allow proper airflow through the system when the vacuum mode is activated. The wet/dry vacuum system also includes a fluid drainage system for removing fluid from the accumulated debris.

18 Claims, 3 Drawing Sheets

WET/DRY VACUUM SYSTEM

FIELD OF THE INVENTION

The present invention is directed to a vacuum system and specifically to a wet/dry vacuum system. The invention is designed to remove fluid and solid particulate debris from swimming pool or spa filter tanks, fireplaces, aquariums, cooling towers and the like.

DESCRIPTION OF PRIOR ART

Wet/dry vacuum systems are used for picking up waste liquids and other debris by means of a vacuum. Examples of these systems are known to the art and can be found in the patent literature. Reference is made to U.S. Pat. Nos. 3,180,071 and 3,343,199 to Nolte, both of which disclose a vacuum cleaner with a liquid pump-out system achieved by air flow into the drum. U.S. Pat. No. 4,179,768 to Sawyer is directed to a wet/dry vacuum system with a water pump-out mode. U.S. Pat. No. 4,179,769 to Lundquist is directed to a vacuum cleaner designed for vacuuming liquids. It has a portable water shutoff device for tank-type vacuums. U.S. Pat. 4,476,608 to Rasmussen is directed to a vacuum system for removing ash and the like, particularly from fireplaces, ash pans, etc.

Most of the prior art wet/dry vacuums include a suction aperture in the center of the collection tank with a diverter, i.e., barrier, directing debris toward the bottom or side of the collection tank and away from the center vacuum system. The vacuum in this system creates a natural cyclone effect, which is useful in vacuuming light debris. However, the utility of the prior art systems diminishes when the systems are called on to vacuum substantially heavier debris, such as that which may be found in swimming pool filter tanks.

Swimming pools and spas commonly choose from four types of systems for the mechanical filtration of water: 1) pleated cloth cartridges; 2) sand and gravel; 3) pressure type diatomaceous earth; and 4) vacuum diatomaceous earth. The filtering media trap dirt and solids while allowing clean water to return to the pool or spa. After long periods of time, the media itself must be either cleaned or discarded.

Cloth cartridge filters are cleaned and reused. Diatomaceous earth filters are flushed to remove the contaminated, dirty diatomaceous earth and recoated with fresh diatomaceous earth. Sand and gravel filters, by design, use a reverse flow of water to "backwash out" trapped particles of debris. However, after a period of neglect, improper water chemistry, freezing, or mechanical failure, the sand or gravel can become non-porous, coagulated or calcified. It is therefore no longer effective for filtration or even circulation. In the case of mechanical failure, the sand or gravel can actually escape the filter tank and deposit into the swimming pool. The only remedy in these situations is to remove the sand or gravel, discard it, make repairs and refill the tank with new sand or gravel.

Swimming pool and spa filter tanks have varying resident capacities between about 100 and 1,600 pounds of sand and gravel. Currently, the industry is switching to filters in the form of blow-molded tanks which, as a result of the manufacturing process, have only one opening. The opening is typically 7 to 9 inches in diameter and provides access for filling and emptying the filter sand and gravel. Because of the large filter tank capacities and their limited service access, replacing the filter material is a chore, generally requiring the removal of the filter sand and gravel by physically scooping it out.

SUMMARY OF THE PRESENT INVENTION

The present invention is specifically designed to remove filter sand and gravel or diatomaceous earth from swimming pool and spa filter tanks in a one-step, convenient manner. The invention will remove the filter sand and gravel, collect it in a bag for transportation, and separate out any fluids that may be present. The fluids may be separated by either gravity draining or by rapidly forcing the fluids from the sand or gravel using air pressure.

The vacuum system of the present invention can be adapted to dry vacuuming, moist vacuuming, and vacuuming of slurry solutions, standing water, gases and other fluids. The system is designed to vacuum particulate debris. For purposes of the present invention, the term "particulate debris" or simply "debris" is intended to include particles having dimensions up to approximately one-half inch in diameter. Debris may include sand, gravel, dirt, and chemical precipitates.

The present invention accomplishes its purpose by providing a wet/dry vacuum system for collecting fluids and particulate debris. The system includes a collection tank having an internal chamber, an interior surface, and an exterior surface. The collection tank includes a removable cover which provides a substantially air-tight connection with the tank. The cover includes an air inlet aperture, for connecting a debris pick-up hose to the collection tank. The air inlet aperture is located off the center point of the cover. The cover also includes an air outlet aperture at a location separate from the air inlet aperture. The air outlet aperture includes means attaching a suction hose to the collection tank. The cover also includes a barrier strip integral with the cover's internal surface. The barrier strip is located between and substantially perpendicular to the air inlet and outlet apertures. The barrier strip is provided with air passage connections located between the ends of the barrier strip and the internal surface of the collection tank, when the cover is in proper placement on the collection tank. An external vacuum source communicates with the suction hose to provide a vacuum to the system.

It is within the scope of the present invention to provide the wet/dry vacuum system with a fluid drainage system to separate and drain out any fluid that may be present in the debris. In one mode, the drainage system operates during the vacuum phase when fluid reaches a certain level in the collection tank. The fluid then automatically drains out of the system while the vacuum mode is in effect.

In another mode, the fluid drainage system comprises means to force fluid from the collection tank without removing the solid particulate debris. The drainage system includes a first upper drainage aperture in communication with a second lower drainage aperture. The first drainage aperture directs pressurized air flow to draw fluid from the collection tank, via application of the venturi effect on the second drainage aperture, when air pressure is added to the collection tank.

While the vacuum system of the present invention is suitable for removing all manner of wet or dry debris, it is specifically suited for sand collection. Because the vacuum system is adaptable to include a water separation mode, it can vacuum all manner of dry, moist or slurried debris for removal, depending upon the situation encountered. This is advantageous in the case of wet sand which has been allowed to dry to a calcified, "rock hard" consistency. In this case, the operator can remoisten the sand to loosen it, vacuum it out and then dewater the vacuumed sand in the collection tank.

The barrier strip attached to the cover of the collection tank provides additional advantages to this invention. The barrier strip is designed to maximize the amount of debris collected to a capacity that can be removed by the operator. The barrier strip provides a reliable, repeatable depositing pattern of sand filling, which will control the vacuum shut-off system and control any filter plugging.

Further objects, features, and advantages of the invention will be apparent from the following detailed description when taken in conjunction with the accompanying drawings.

DETAILED DESCRIPTION OF THE INVENTION

Figure 1:
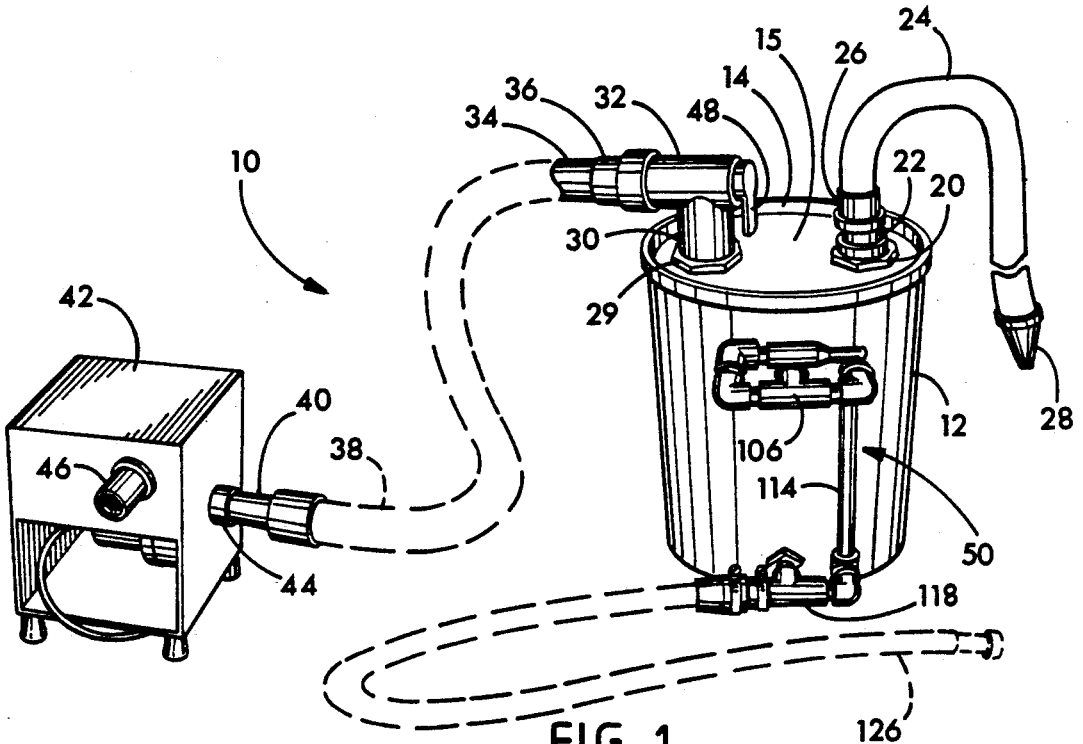
Fig. 1 is a perspective view of the vacuum system of the present invention.

Referring to the drawings, and in particular to FIG. 1, there is illustrated the vacuum system of the present invention, generally designated by reference numeral 10. The vacuum system 10 includes a collection tank 12 in the form of a pail or drum. It is within the scope of the present invention to provide the collection tank 12 with a variety of sizes and shapes. For purposes of the present invention, the collection tank 12 has been illustrated in cylindrical form. The collection tank 12 may be made of a variety of materials, but must be sufficient to withstand the rigors of vacuuming. Examples of suitable materials include steel, aluminum or other metals, plastic and composites.

Figure 7:
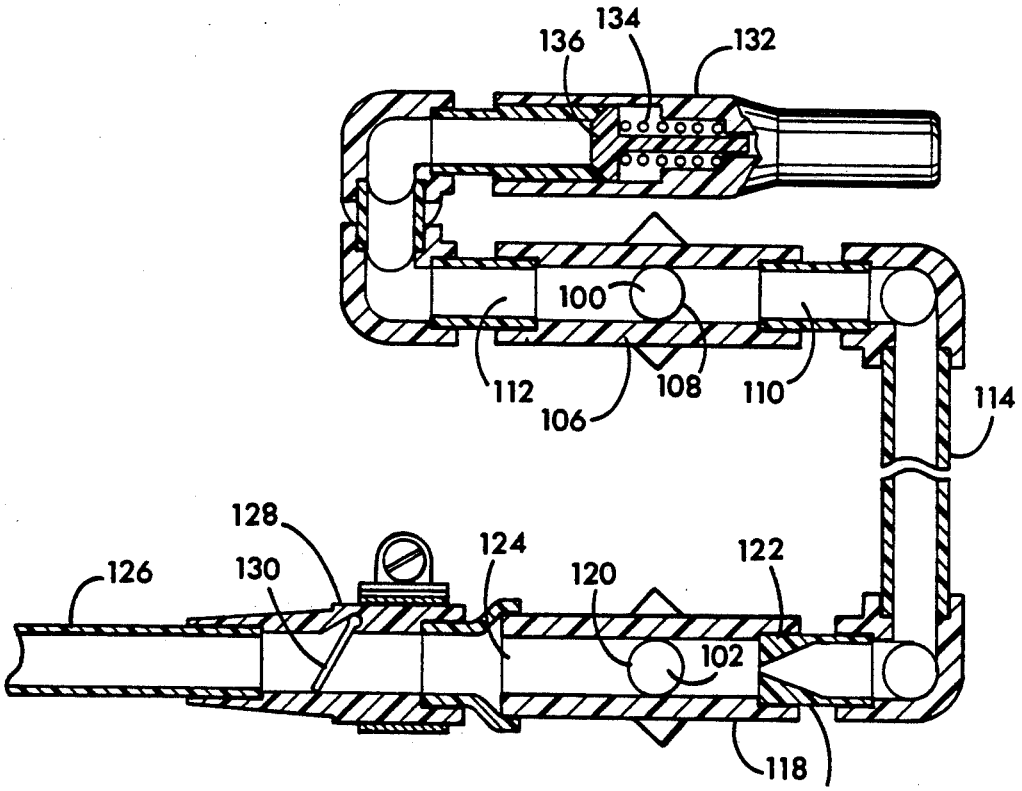
FIG. 7 is a partial cross-sectional view of the fluid drainage system taken along lines 7—7 of FIG. 6.
Figure 3:
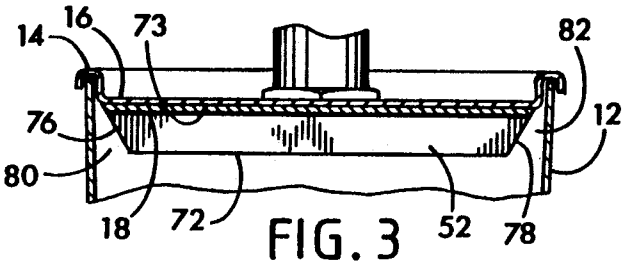
FIG. 3 is a cross-sectional view of a portion of the collection tank of FIG. 2 taken along lines 3—3.
Figure 6:
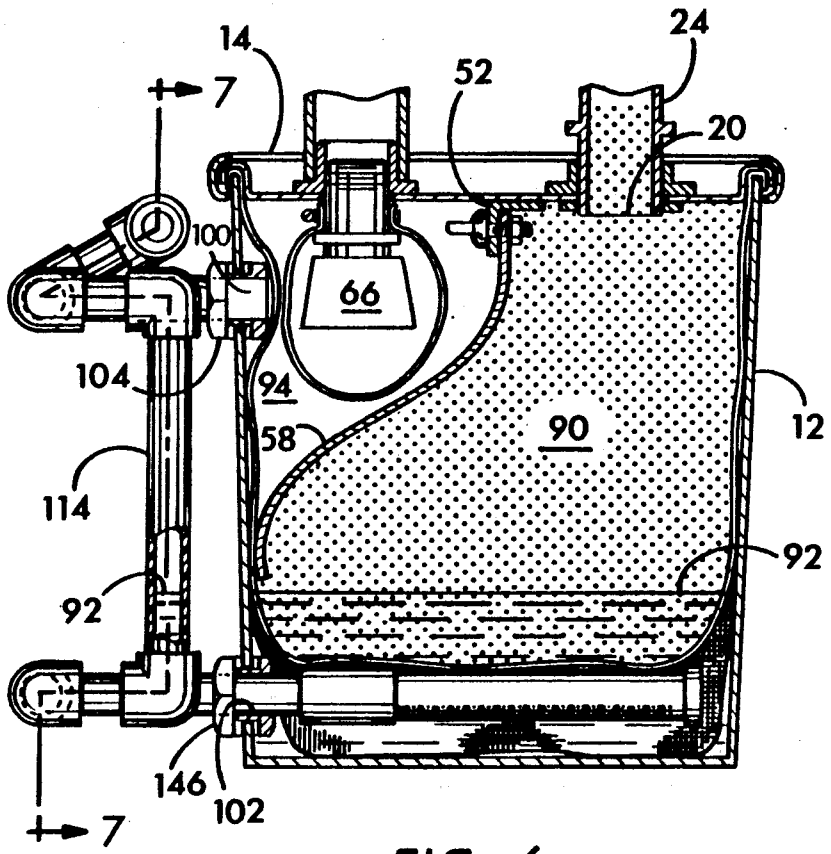
FIG. 6 is a cross-sectional view of the collection tank of the present invention showing the debris fill pattern in the collection tank.

The collection tank 12 is provided with a removable cover 14, which can be made of the same material as the collection tank 12. The cover 14 is designed to be connected to the tank 12 in airtight fashion. In this manner, the cover 14 can be connected to the tank 12 by means of a lever lock clamping ring, not illustrated. The cover 14 has an external surface 16 and an internal surface 18, as illustrated in FIGS. 3, 6 and 7.

The cover 14 is further distinguished by two apertures 20 and 29 provided with couplings 22 and 30, respectively, for hose connections. The first inlet aperture 20 preferably includes a quick disconnect coupling 22 for attaching a debris pick-up hose 24. The pick-up hose is a generally flexible hose, preferably made of polyvinyl chloride (PVC) having a length between approximately 6 and 8 feet. One end 26 of the pick-up hose 24 is attached via coupling 22 to the cover 14. The other end 28 of the pick-up hose 24 is designed to pick up debris via a vacuum and transport the debris to the collection tank 12. A variety of attachments may be added to the end 28 to assist in picking up and removing debris.

The second outlet aperture 29 on the cover 14 includes a coupling fitting 30 to which is attached a valve 32. Connected to the valve 32 is a suction hose 34. The suction hose is similar to the pick-up hose in that it is a generally flexible hose, preferably made of PVC and having a length between 6 and 8 feet and constructed with a larger diameter than the pick-up hose. The suction hose 34 is connected at one end 36 to the valve 32. The second end 38 of the suction hose 34 is provided with an adapter 40 to enable the suction hose 34 to be connected to a disconnected vacuum source 42 at the air intake end 44. The vacuum force is a standard vacuum/blower motor, generally known and widely used in construction and commercial industries. It includes the air intake aperture 44 and a forced-air evacuation aperture 46.

Preferably, the valve 32 is a throttle valve, which is known and commercially available for controlling fluid flow. The adjustable feature, which may be operated by the handle 48, controls the air flow capacity through the valve 32, which controls the air flow capacity through the collection tank 12. An example of a preferred and commercially available valve is a 2-inch 90° Ortega-type valve with a 180° rotatable handle (Purex Pool Equipment). This adjustable feature will allow for vacuum reduction if desired, and for air flow control when using the fluid drainage system, which will be discussed later.

Another feature of the present invention is the fluid drainage system 50, which is attached to the collection tank 12, as illustrated in FIG. 1.

Figure 2:
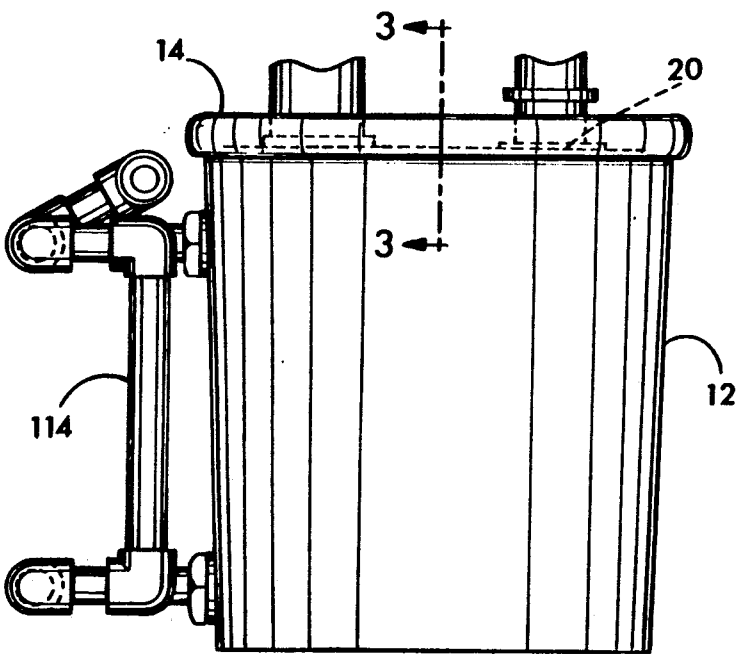
FIG. 2 is a side elevation view of the collection tank and the fluid drainage system.

Referring now specifically to FIGS. 1, 2 and 3, the locations of the inlet aperture 20 and outlet aperture 29 will be described. While the apertures 20 and 29 may be placed in a variety of locations on the cover 14, at least one aperture must be placed off of the center location, generally designated by reference numeral 15. The location and positioning of the apertures 20 and 29 are particularly important in relation to a barrier strip 52, illustrated in FIG. 3. The strip 52 is critical in controlling the amount of debris that can be vacuumed into the collection tank 12 and the debris depositing pattern in the tank.

The barrier strip 52 is a rigid strip, which is integrally connected to the internal surface 18 of the cover 14. The barrier strip 52 is approximately one inch to three inches in width and has a length shorter than the length or diameter of the cover 14. The length and width of the barrier strip 52 can be adjusted to vary the capacities and depositing patterns of the debris flowing into the collection tank 12. A preferred barrier strip is approximately 1½ inches wide. The barrier strip 52 is located between and generally perpendicular to the apertures 20, 29.

Figure 5:
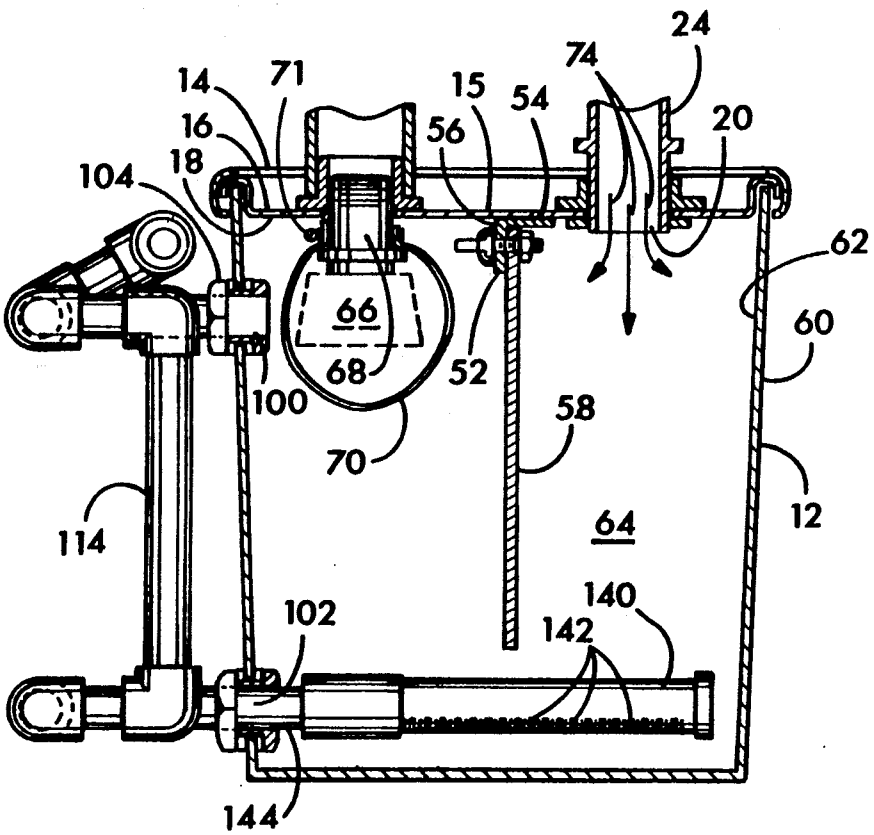
FIG. 5 is a cross-sectional view of the collection tank taken along lines 5—5 of FIG. 4.

As illustrated in FIGS. 5 and 6, the barrier strip may be in the form of an angle iron. One leg 54 is attached to the internal surface 18 of the cover 14 by means of welding, adhesive, bolts or the like, and the other leg 56 depends from the internal surface 18 of the cover 14. As illustrated in FIGS. 5 and 6, the barrier strip 52 may be provided with a flexible extension 58, which will be discussed later.

Referring now to FIG. 5, which is a cross-sectional view of the collection tank 12, the tank is represented on its external surface by reference numeral 60 and its internal surface by reference numeral 62. The internal surface 62 of the tank 12 surrounds the internal chamber 64 of the tank.

A preferred feature of the vacuum system of the present invention is a strainer 66, which is located in the internal chamber 64. The strainer 66 is a perforated metal or plastic basket, which is attached via a conduit 68 to the coupling 30 of the outlet aperture 29. As illustrated in FIGS. 5 and 6, the conduit 68 may be threadably attached to the coupling 30. Other means of attachment are also contemplated. The strainer 66 is designed to prevent the intake of particulate debris into the suction hose 34, which debris might then travel to the vacuum motor 42 causing damage. To further protect the strainer 66, a flexible filter bag 70, preferably comprised of a porous cloth or polypropylene material, is attached to the strainer attachment 66, generally in the area of the conduit 68, by an attachment mechanism 71. The attachment mechanism 71 is known to the art and can include, without limitation, attachment clips and elastic bands. The filter fabric is provided with a weave sized to prevent small particle, i.e., sand, passage and yet allow maximum air flow through the suction hose 34.

The present invention also contemplates a fluid shut-off valve, generally known to the art but not illustrated, for use in turning off the vacuum mechanism when a certain fluid level has been attained in the collection tank 12. The shut-off valve is contemplated to be located in the general direction of the strainer attachment 66.

Referring now to FIGS. 3 and 5, the barrier strip 52 is designed to deflect particulate debris entering the collection tank 12 from the strainer attachment 66. The deflection inhibits any clogging of the strainer attachment 66, thereby allowing capacity filling of the collection tank 12. When the vacuum system is operating, a vacuum is applied to suction hose 34, which draws air from the internal chamber 64 of the collection tank 12 and the pick-up hose 24. The resulting vacuum allows particulate debris to be drawn into the second end 28 of the pick-up hose 24 and carried to the collection tank 12. As the debris enters the collection tank at the area of the inlet aperture 20, the lighter debris mass will naturally expand to the volume of the internal chamber 64 according to the arrows 74. The barrier strip 52 is designed to deflect any debris traveling in the direction of the strainer attachment 66.

For heavier debris, such as sand and gravel, the strip 52 will not deflect particles suspended in air flow as much as it will contain and direct a depositing pattern of debris. The heavier debris generally drops down to the floor of the collection tank 12. As the debris is deposited on the floor of the collection tank, it spreads out and rises in a conical shape with the apex of the cone rising below the aperture 20. As the debris rises, it eventually contacts the barrier strip 52. The barrier strip 52 forms a restraining wall directing the debris away from the strainer 66 and toward the aperture 20. When the debris enters the aperture 20, vacuum air flow in the hose 24 ceases. At this point, a large pocket 94 is formed around the strainer 66, keeping it free of debris, while simultaneously filling the remainder of the tank.

Referring now to FIG. 3, the barrier strip 52 is defined by a lower edge 72, an upper edge 73, and connecting side edges 76, 78, respectively. The lower edge 72 is shorter in length than the upper edge 73 in order to provide air passage connections 80, 82 in the internal chamber 64. The air passage connections 80, 82 are important to create an even flow of air, which is forced through the internal chamber 64 of the collection tank during the vacuum mode. Preferably, the barrier strip 52 is formed such that the side edges 76, 78 are at an approximately 45° angle with respect to the upper edge 73.

Referring now to FIG. 5, reference is made to the barrier strip extension 58, which is formed of a flexible material and extends below the lower edge 72 of the barrier strip 52. As illustrated in FIGS. 5 and 6, the barrier strip extension 58 further assists the barrier strip 52 in keeping the strainer 66 free of debris. The extension 58 assists in spreading out the debris, which accumulates in the collection tank 12. The extension material is preferably a flexible imperforate material, such as rubber. The extension 58 is mounted to the barrier strip 52 according to means known to the art. As illustrated in FIGS. 5 and 6, the extension is mounted by means of bolts and wing nuts.

The width of the barrier strip 52 is designed to be not greater than the length of the lower edge 72 in order to continue the gap created by the air passage connections 80, 82. The length of the extension 58 can be changed to vary the amount of debris collected in the collection tank 12. As the length of the extension 58 is extended, less debris will be collected in the collection tank. For example, a 6-inch long extension strip will collect approximately 10 pounds more sand in the collection tank 12 than a 12-inch long extension. The present invention contemplates the addition of a variety of attachments to the extension 58 to accommodate the nature of the debris being vacuumed.

Referring now to FIG. 6, there is illustrated a cross-sectional view of the collection tank 12 in which an accumulation of debris 90 has been vacuumed into the internal chamber 64 of the tank. As illustrated, the debris 90 includes a certain level of fluid 92.

The vacuuming is accomplished as described earlier with respect to FIG. 5. Debris 90 continues to be vacuumed into the internal chamber 64 until the debris plugs the tank 12 at the area of the inlet aperture 20. Accumulation of the debris 90 at the aperture 20 causes an immediate and automatic shut-off of air flow in the tank 12. At this point, the air flow in the vacuum motor 42 is disconnected, and the debris can be removed from the collection tank.

FIG. 6 illustrates the manner of final placement of the debris 90. As illustrated, the barrier strip 52, in combination with the extension 58, creates a protective chamber 94 surrounding the strainer attachment 66. Debris 90 is then prevented from prematurely clogging the strainer attachment 66.

The present invention preferably includes a bag liner 96, illustrated in FIG. 6, for accumulating and removing the debris 90 from the collection tank 12. The bag liner 96 is made of a porous woven fabric material, similar to bags commercially available for transporting sand. The liner 96 is sewn to a circumference matching that of the internal chamber 64 of the collection tank 12, with a length approximately 6–12 inches greater than the height of the collection tank. The additional length is designed to allow the bag to be draped around the top lip of the collection tank. The cover 14 is then placed in sealing attachment on the collection tank 12, thereby fixing the position of the bag 96 in the collection tank. The bag is not only used to collect and haul debris away, but also acts as an initial fluid separator. When the bag 96 is draped inside the collection tank 12, it acts as a filter screen for the fluid drainage mechanism. Preferably, the bags are constructed to be allowed for reuse.

The vacuum system 10 of the present invention also preferably incorporates a fluid drainage system 50, designed to separate and drain out any collected fluid that may be present in the debris vacuumed into the collection tank 12 in a non-clogging manner. The drainage system operates by either gravity drainage or by rapidly forcing the fluid out using air pressure.

Referring to FIGS. 2 and 4–7, the fluid drainage system 50 will now be described. The drainage system 50 is designed to be attached to the external surface 60 of the collection tank 12. In order to accommodate the drainage system, the collection tank 12 is provided with two apertures: a first upper drainage aperture 100 and a second lower drainage aperture 102. The drainage apertures 100 and 102 are designed to communicate with each other by a series of conduits. The conduits are formed of straight pipes connected by elbows and/or pipe tees, all of which are known to the art. It is of course within the scope of the present invention to provide a single-piece extruded pipe having proper angles and bends. Conduits may be made of any material designed to accept the flow of fluids. Preferably, the conduits are made of a plastic or PVC, unless otherwise stated.

Figure 4:
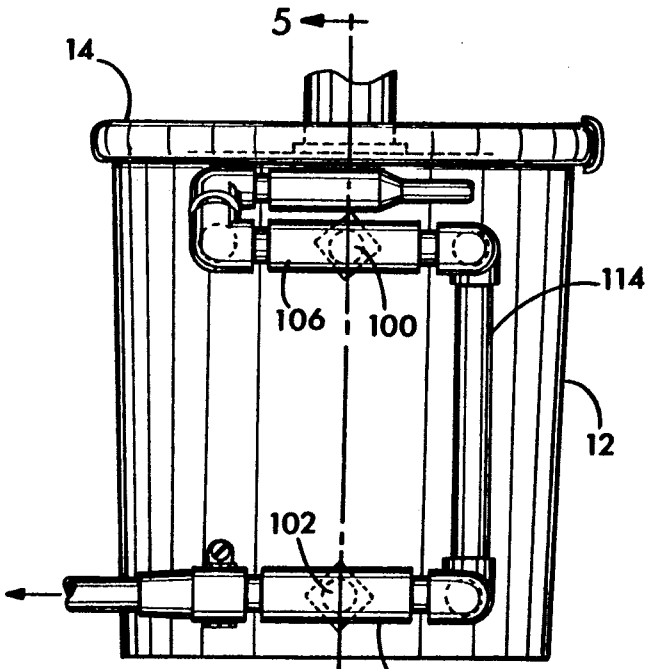
FIG. 4 is a side elevation view of the collection tank of the present invention positioned to illustrate a side elevation view of the fluid drainage system.

Communicating with the upper aperture 100 by a coupling device 104 is a tee 106. The tee 106 includes a first opening 108, a second opening 110, and a third opening 112. The tee 106 is placed in a substantially horizontal configuration, as illustrated in FIG. 4. The opening 110 communicates with a vertical sight tube 114. The reason for designating tube 114 as a "sight tube" is that it is preferably a transparent tube. As such, it can be used to determine the level of fluid in the accumulated debris 90 in the collection tank 12. The level of fluid in the sight tube 114 is apparent with or without the vacuum source operating. Reference is made to FIG. 6 for an appropriate illustration.

Located off the opening 112 of the tee 106 is a pressure check valve 132 designed (1) to relieve excess air volume and pressure build-up in the collection tank 12 when forced air/water separation is in effect, (2) to regulate a constant maximum air flow through the drainage system 50, and (3) to act as a fluid drain source from the tank should the fluid level exceed capacity level, at the start of forced air/water separation.

While a variety of pressure check valves is contemplated, the preferred valve is illustrated as a spring-loaded check valve, having a spring 134 and activated valve stopper 136. The pressure check valve 132 has a one-way flow direction opening to the atmosphere.

Like aperture 100, aperture 102 is also provided with a tee 118, similar in appearance and function to the tee 106. The tee 118 is provided with a first opening 120, which communicates with the aperture 102, a second opening 122, which communicates with the sight tube 114, and a third opening 124, which communicates with a fluid discharge hose 126.

In a preferred mode, a drain-out check valve 128 is positioned between the tee 118 and the discharge hose 126. Although a variety of check valves are contemplated, the preferred embodiment is a swing check valve, which includes a valve cover 130 rotatably positioned in the check valve 128. The valve cover 130 is oriented to close upon the introduction of a vacuum into the collection tank 12 and open upon the introduction of air pressure into the system. The weight of the valve cover 130 maintains the valve in a closed position at atmospheric pressure by gravity. The weight is also needed to provide resistance to opening the valve.

The lower tee 118 is characterized at the second opening 122 by a reducing orifice 138. The orifice is used to greatly increase the air velocity through the tee 118, creating a natural venturi vacuum at the center portion of the tee 118 between the ends 122, 124.

Referring now to FIGS. 5 and 6, there is illustrated a drain lateral 140 located in the internal chamber 64 and communicating with the lower tee 118. The drain lateral 140 is a preferably circumferential tubing, approximately 9 inches long with a series of parallel slots 142. Drain laterals, as illustrated by the reference numeral 140, are known to the art and commercially used by swimming pool filter tank manufacturers. The drain lateral is connected to the lower tee 118 by means of flexible tubing 144. The drain lateral 140 is designed to allow for heavy sand build-up in the internal chamber 64 while inhibiting any flow of debris into the fluid drainage system 50. The drain lateral 140 can easily be removed for cleaning.

Referring now to FIGS. 4 and 7, the third end 124 of the lower tee 118 is designed to mount to a coupling 146 to allow for connection of the drain hose 126. The coupling 146 and the drain hose 126 should be of a diameter larger than the lower tee 118 in order to provide a maximum venturi effect through rapid air/water draining from the fluid drainage system. The length of the drain hose 126 can be changed as the job requires. If desired, a typical garden hose connection can be installed in place of the drain hose 126 for coupling to a remote water removal location. However, if the diameter of the hose 126 is less than the diameter of the lower tee 118, a back pressure of fluid will result in the tee 118 removing the venturi-effect advantages. If this occurs, the pressure of air in the collection tank can be adjusted by the throttle valve 32.

In operation, the system of the present invention enables the fluid 92, which has been vacuumed into the collection tank along with debris 90, to automatically exit the tank 12 even when the system is in the vacuum mode. Water level can be monitored in the tank 12 via the sight tube 114. Fluid evacuation occurs when the fluid level in the tank 12 is filled such that the sight tube 114 registers at least about ⅓ full. If the fluid level rises to about the approximately ⅓ full level, the operator can momentarily pause the vacuuming operation while the vacuum source is still activated, and the fluid will flow out of the tank 12 via the fluid drainage system 50 until the ⅓ capacity level is again reached.

Thus, the drainage only occurs during a pause in vacuuming. In this manner, fluid can be drained from the tank 12 even prior to removing the vacuum from the tank.

Positive pressure fluid drainage works by using a reverse flow of air supplied by the vacuum/blower motor 42. In this manner, the adapter 40 of the suction hose 34 is disconnected from the air intake aperture 44 and attached to the forced air evacuation aperture 46. The vacuum motor is turned on and the throttling valve 32 is rotated to allow air into the internal chamber 64 of the vacuum tank. The air, which is forced into the internal chamber 64, passes through the upper aperture 100 into the fluid drainage system 50. Air is forced down the sight tube 114 and blasted into the lower tee 118. As a result of the reducing orifice 138, the velocity of air entering the lower tee 118 from the sight tube 114 is greatly increased. This forced airstream current, rushing past the first opening 120, will establish a venturi effect, thereby, inducing a negative pressure, i. e., a vacuum, at the aperture 102.

The pressurized air in the system has three basic routes of flow. Because air follows a path of least resistance, the bulk of the air will follow the route previously described and pass through the third opening 124 of the lower tee 118. The forced air current creates a vacuum in the area of the first opening 120 in the lower tee 118 via the venturi effect. This vacuum causes fluid in the tank 12 to flow into the fluid system via the drain lateral 140 and the tubing 144. The fluid mixes with the air passing through the lower tee 118 and exits out of the tee to the drainage hose. The force of air will open the valve cover 130 allowing the fluid to be removed. The pressure valve 132 prevents any damage to the system by allowing excess air and water to vent from the valve 132.

The second air path is directed through the debris 90, into the drain lateral 142, and into aperture 102 to the center of tee 118, where it meets the concentrated airflow from the orifice 138. At this point, the combined airflows will mix and rapidly exit out the tee 118 to the drainage hose 126. The force of air will open the valve cover 130 allowing the fluid/air mix to be evacuated.

The third air path flows through the debris 90, the cover aperture 20 and out the pickup hose 24. This loss of airflow can be controlled by blocking the end of the pickup hose. At times, it may be desirable to control the rate of fluid separation. This can be accomplished by blocking the airflow through the pickup hose. Alternatively, the pickup hose end 28 may be attached to the evacuation aperture 46 of the motor 42 for the fluid separation mode. In this case, the throttle valve 32 can be used to control the rate of separation. The pressure valve 132 prevents damage to the system or operator by allowing excess water and air to vent.

After the required amount of fluid has been evacuated from the collection tank 12, the forced air pressure is stopped by turning off the motor 42. The cover 14 may then be removed from the collection tank 12 and the dried debris 90 can be removed. If a bag liner 96 is in place, the debris 90 is easily removed without mess.

It is understood that the invention is not confined to the particular construction and arrangement herein illustrated and described, but embraces such modified forms thereof as come within the scope of the following claims.

What is claimed is:

1. A wet/dry vacuum system for collecting liquids and particulate debris comprising:

a. a collection tank having an internal chamber, an interior surface and an exterior surface;

b. a removable cover providing a substantially airtight connection with the tank, the cover having an external surface and an internal surface;

c. an air inlet aperture in the cover, the air inlet aperture including means connecting a pick-up hose to the collection tank, the air inlet aperture being located off the center point of the cover;

d. an air outlet aperture in the cover at a location separate from the air inlet aperture, the air outlet aperture including means attaching a suction hose to the collection tank;

e. a barrier comprising a barrier strip integral with the internal surface of the removable cover for debris containment, the barrier strip being attached to the cover between the air inlet and air outlet apertures and depending downwardly into the internal chamber of the collection tank, and the barrier further comprising a flexible extension separably attached to the barrier strip and depending downwardly from the barrier strip into the internal chamber of the tank, wherein the flexible extension separates debris entering the air inlet aperture from the air outlet aperture and substantially prevents debris build-up from penetrating the air outlet aperture, the flexible extension being provided with side edges and air passage connections between the side edges and the internal surface of the collection tank; and f. an external vacuum source in communication with the suction hose.

2. The system of claim 1 wherein the air outlet aperture includes a throttling valve to regulate air passage through the air outlet.

3. The system of claim 1 wherein the flexible extension has a width shorter than the width of the collection tank to allow for air flow around the flexible extension.

4. The system of claim 1 further comprising a filtering means between the internal chamber of the collection tank and the suction hose.

5. The system of claim 1 further comprising a removable liquid permeable bag liner within the interior chamber to trap the solid particulate debris vacuumed into the collection tank.

6. The system of claim 1 further comprising a liquid drainage system to separate and drain out any liquid that may be present in the collected debris.

7. The system of claim 6, wherein the liquid drainage system includes a liquid sight tube.

8. A wet/dry vacuum system for collecting liquids and particulate debris comprising:

a. a collection tank having an internal chamber, an interior surface and an exterior surface;

b. a removable cover providing a substantially airtight connection with the tank, the cover having an external surface and an internal surface;

c. an air inlet aperture in the cover, the air inlet aperture including means connecting a pick-up hose to the collection tank, the air inlet aperture being located off the center point of the cover;

d. an air outlet aperture in the cover at a location separate from the air inlet aperture, the air outlet aperture including means attaching a suction hose to the collection tank;

e. a flexible barrier for debris containment, the barrier being attached to the cover between the air inlet and air outlet apertures and depending downwardly into the internal chamber of the collection tank, wherein the barrier is adapted to separate debris entering the inlet aperture from the air outlet aperture and to prevent debris build-up from penetrating the air outlet aperture, the flexible barrier being provided with air passage connections between barrier side edges and the internal surface of the collection tank; and f. an external vacuum source in communication with the section hose; and g. means to force the liquid from the collection tank without removing the solid particulate debris, the means comprising a first upper aperture in communication with a second lower aperture, wherein the second aperture draws liquid from the collection tank via application of the venturi effect when air pressure is added to the collection tank by an external blower source.

9. The system of claim 8 wherein the second aperture comprises a drainout check valve oriented to close upon the application of a vacuum and open upon the application of air pressure.

10. The system of claim 9 wherein the drainout check valve remains closed at atmospheric pressure.

11. The system of claim 8 further comprising a pressure check valve, the pressure check valve being adapted to relieve excess air volume and pressure buildup in the collection tank, regulate a constant air flow to maintain the venturi effect through the second aperture, and provide a liquid drain source from the collection tank.

12. The system of claim 8 further comprising a drain lateral in the collection tank, the drain lateral in communication with the second aperture.

13. The system of claim 8 further comprising a drain hose coupled to the second aperture, the drain hose having a diameter larger than the diameter of the second aperture to assist the venturi effect.

14. A wet/dry vacuum system for collecting liquids and particulate debris comprising:

a. a collection tank having an internal chamber, an interior surface and an exterior surface;

b. a removable cover providing a substantially airtight connection with the tank, the cover having an external surface and an internal surface;

c. an air inlet aperture in the cover, the air inlet aperture including means connecting a pick-up hose to the collection tank, the air inlet aperture being located off the center point of the cover;

d. an air outlet aperture in the cover at a location separate from the air inlet aperture, the air outlet aperture including means attaching a suction hose to the collection tank;

e. a flexible barrier for debris containment, the flexible barrier being attached to the cover between the air inlet and air outlet apertures and depending downwardly into the internal chamber of the collection tank, wherein the flexible barrier separates debris entering the inlet aperture from the air outlet aperture and prevents debris build-up from penetrating the air outlet aperture, the flexible barrier being provided with barrier side edges and air passageways between the barrier side edges and the internal surface of the collection tank; and f. an external vacuum source in communication with the suction hose; and g. means to force the liquid from the collection tank without removing the solid particulates debris, the means comprising the first upper aperture in communication with a second lower aperture, wherein the second aperture draws liquid from the collection tank via application of the venturi effect when air pressure is added to the collection tank.

15. The system of claim 14 wherein the second aperture comprises a drainout check valve oriented to close upon the application of a vacuum and open upon the application of air pressure.

16. The system of claim 14 further comprising a pressure check valve, the pressure check valve being adapted to relieve excess air volume and pressure buildup in the collection tank, regulate a constant air flow to maintain the venturi effect through the second aperture, and provide a liquid drain source from the collection tank.

17. The system of claim 14 further comprising a drain lateral in the collection tank, the drain lateral being in communication with the second aperture.

18. The system of claim 14 further comprising a drain hose coupled to the second aperture, the drain hose having a diameter larger than the diameter of the second aperture to assist the venturi effect.

* * * * *